United States Patent [19]

Cardin

[11] Patent Number: 4,623,421

[45] Date of Patent: Nov. 18, 1986

[54] TAPE APPLICATOR

[76] Inventor: Auther B. Cardin, 1527 North Water, Cape Girardeau, Mo. 63701

[21] Appl. No.: 634,476

[22] Filed: Jul. 24, 1984

[51] Int. Cl.[4] ..... B32B 31/18; B32B 31/20

[52] U.S. Cl. ..... 156/523; 156/577; 156/579

[58] Field of Search ..... 156/523, 527, 574, 577, 156/579, 526, 575

[56] References Cited

U.S. PATENT DOCUMENTS

| | | | |
|---|---|---|---|
| 2,493,502 | 1/1950 | Renne, Jr. | 156/526 |
| 2,732,964 | 1/1956 | Neer | 156/523 |
| 3,536,569 | 10/1970 | Gosnell | 156/527 |
| 3,730,815 | 5/1973 | Terzian | 156/527 |
| 3,740,297 | 6/1973 | Vidinsky | 156/523 |
| 3,814,643 | 6/1974 | Wagner | 156/527 |
| 3,871,940 | 3/1975 | Antonioni | 156/523 |

*Primary Examiner*—Michael Wityshyn

*Attorney, Agent, or Firm*—Berman, Aisenberg & Platt

[57] ABSTRACT

A tape applicator is disclosed wherein a roll of tape and pressure roller are located in a cavity of a body. An outer surface of the cavity serves to align the pressure roller to permit application of the tape in a desired direction. The pressure roller includes a side surface which is coplanar with a side surface of the body whereby alignment of the body automatically aligns the pressure roller which in turn aligns the tape being applied. In the preferred embodiment, the body includes two guide surfaces which are adapted to engage a surface on which tape is to be applied. Alignment guides may be attached to the guide surfaces to engage a vertical surface to accurately align the apparatus. A handle extends outwardly and includes a trigger for operating a knife blade to sever the tape.

8 Claims, 4 Drawing Figures

TAPE APPLICATOR

TECHNICAL FIELD

This invention relates to articles useful for applying tape to a surface.

BACKGROUND ART

Apparatus for applying tape to a surface are known in the art. One use for such an apparatus is in the application of tape to an object for making the object secure. For example, it is common to prepare a package for mailing by wrapping it in a strong tape. Another type of apparatus for applying tape is designed to be used with masking tape for the purpose of covering one portion of a surface while allowing a second portion to be painted.

U.S. Pat. No. 2,500,157 (Deutsch) shows an apparatus for applying adhesive tape to a surface. A first roller holds the tape, while a second roller receives tape from the first roller and applies it to a surface. A knife blade is oriented with respect to the second roller such that the tape is severed for one orientation of the apparatus. This device finds primary utility in wrapping boxes since there is no provision for efficiently aligning the tape.

U.S. Pat. No. 3,582,438 (Harbour) shows a tape handling apparatus wherein a plurality of rollers are required for operation. One roller carries tape to be applied, and a second roller receives tape from the first roller for contacting the surface on which the tape is to be placed. Each of the first and second rollers is mounted to a side of a common base and extends outwardly therefrom.

U.S. Pat. No. 3,871,940 (Antonioni) shows a tape dispenser having a first roller for carrying the tape to be applied, and three additional rollers for directing the tape over a pressure pad which applies the tape to a surface. A housing includes a pair of small rollers which project outwardly from a top wall of the housing. When the dispenser is moved along a vertical surface, tape will be applied to a horizontal surface in alignment with the vertical surface because of engagement between the rollers and the vertical surface.

U.S. Pat. No. 3,902,956 (Thompson Jr.) shows a device for applying double-sided tape. This apparatus includes a braking device which prevents rotation of a pressure roller to cause the tape to break.

Swiss Pat. No. 420,975 discloses a tape dispenser wherein a first roller carries tape and two additional rollers apply tape to a surface. When one of the additional rollers is moved with respect to a second additional roller, a knife blade engages the tape and severs it.

SUMMARY OF THE INVENTION

None of the above-described prior art devices provides a simple means for aligning tape to be applied to a surface. For example the alignment device shown in the Antonioni patent requires a vertical surface extending upwardly from the horizontal surface on which tape is to be applied. This places a severe restriction on the use of the apparatus because not every horizontal surface is associated with a vertical surface extending upwardly from it.

In accordance with the invention, a tape dispenser is provided wherein a body supports a first roller for carrying tape to be applied and a second roller for receiving tape from the first roller and applying the tape to a surface. The second roller is commonly known as a pressure roller since it places the tape upon the surface under pressure.

The rollers are received in a cavity in the body such that a side portion of the body is aligned with a side of the pressure roller. By this arrangement, alignment of the side portion of the body automatically aligns the roller which in turn automatically aligns the tape being applied.

The body also includes guide surfaces which preferably extend perpendicularly to the side portions and are tangent to the outer surface of the pressure roller. This provides an extremely convenient guide surface which facilitates placing the tape in a desired location. Alignment attachments may be affixed to the guide surface for engaging an edge when it is desired to place the tape along the edge. These alignment devices are removable to allow use of the tape dispenser in other ways.

The tape dispenser preferably provides two guide surfaces symmetrically located about a line connecting the two rollers. This arrangement allows a handle to extend parallel to the guide surfaces and be operated in either of two directions.

An object of this invention is to provide a tape dispensing apparatus having alignment surfaces for facilitating alignment of the tape.

Another object of this invention is to provide a tape dispenser wherein two guide surfaces allow operation of the dispenser in different directions.

A still further object of this invention is to provide a tape dispenser wherein a tape roller and a pressure roller are contained within a cavity, an outer surface of the cavity being coplanar with a side of the pressure roller.

DETAILED DESCRIPTION OF THE INVENTION

Figure 1:
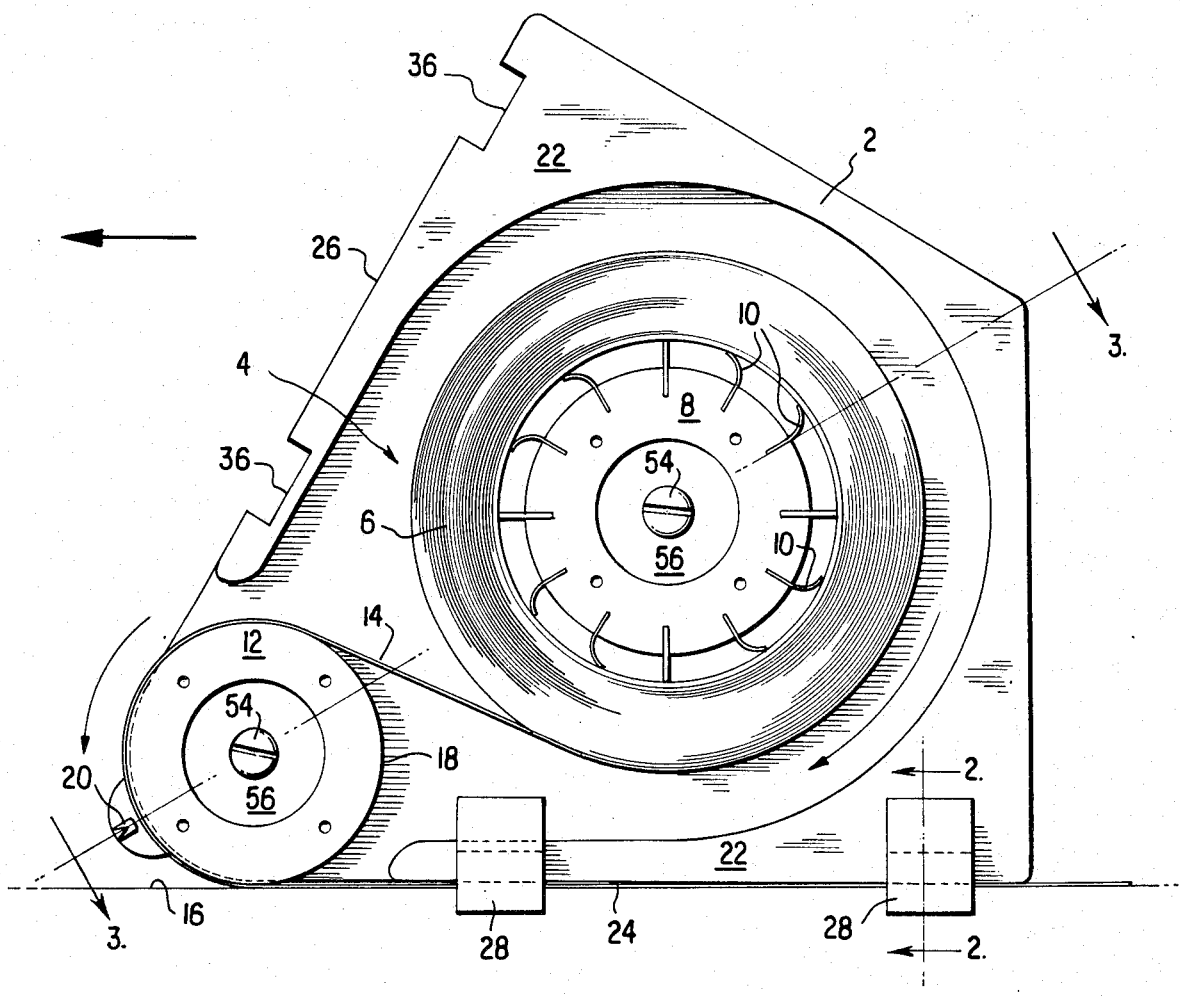
FIG. 1 is a side view of an apparatus in accordance with the invention.

FIG. 1 is a side view of a tape dispenser in accordance with the invention shown applying tape to a surface. A body 2 includes a cavity 4 which receives a roll of tape 6. The roll 6 of tape is mounted on a roller 8 which is secured to the body 2 in a manner more fully shown in FIG. 3. A plurality of flexible fingers 10 extend outwardly from the roller 8 to engage an inner surface of the roll 6 of tape.

Figure 3:
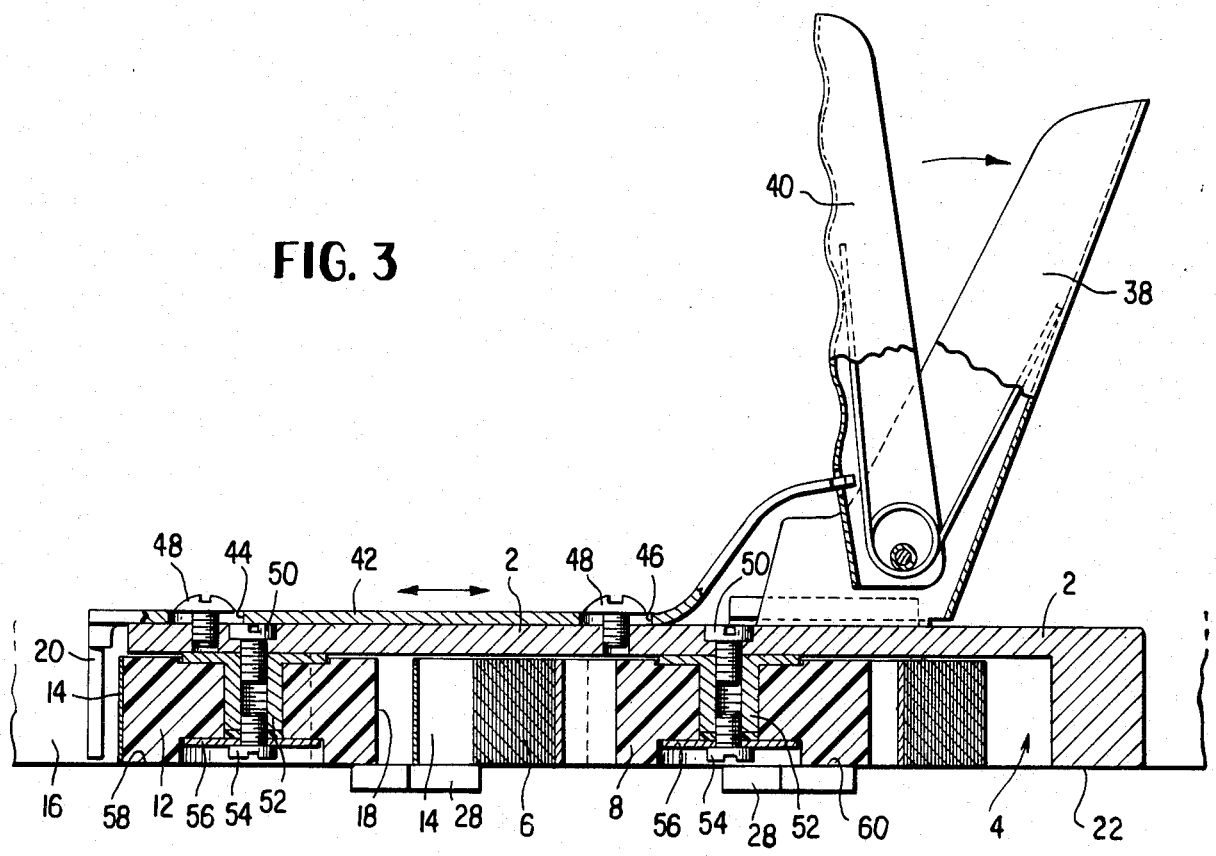
FIG. 3 is a cross section of the apparatus taken along line 3—3 of FIG. 1.

A second roller 12 is mounted to the body 2 in a manner which will also be more fully described with respect to FIG. 3. Roller 12 receives tape 14 from the roll 6 of tape and applies it to a surface 16. It will be appreciated that FIG. 1 illustrates application of one-sided tape; tape 14 is peeled from roll 6 and passes over an outer surface 18 of the roller 12 such that the side having an adhesive faces outwardly to engage the surface 16.

After the tape has been applied, it is cut by knife blade 20 as will be more fully described below.

Body 2 includes a side surface 22 which is coplanar with side surfaces of roller 12 and tape roll 6. This means that when the side surface 22 is aligned with a given direction, a side surface of roller 12 will be aligned with that same direction. A first guide surface 24 extends perpendicularly to side surface 22 and is tangent to outer surface 18 of roller 12. By this arrangement, tape 14 encounters surface 16 and roller 12 causes the tape to adhere to surface 16 in a direction mandated by the alignment of surface 22. Since guide surface 24 is tangent to outer surface 18, pressure on the entire apparatus will be distributed between the pressure roller 12 and the guide surface 24 to efficiently move along the surface 16 and apply tape 14 to the surface.

A second guide surface 26 is formed by the body 2 and has a relationship with respect to roller 12 similar to that of guide surface 24. In a preferred embodiment, guide surfaces 24 and 26 are symmetrical with respect to a line connecting the centers of rotation of rollers 8 and 12. Thus, the device may be turned over to allow guide surface 26 to apply tape so that the device may be used in either of two directions.

Figure 2:
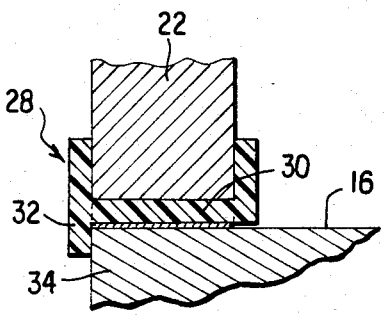
FIG. 2 is a partial cross section taken along line 2—2 of FIG. 1.

Alignment guides 28 are designed to be attached to either of the guide surfaces 24 or 26 to facilitate alignment of the tape with respect to an edge. As shown in FIG. 2, the alignment guide 28 includes a U-shaped portion 30 which engages body portion 22, and a depending portion 32 extends downwardly from the U-shaped portion 30 to engage a side surface 34 which is a part of the object containing surface 16.

Notches 36 are formed in body 22 to receive alignment guide 28. This allows the outer surface of the U-shaped portion 30 to be coplanar with guide surface 24.

FIG. 3 shows the preferred construction of the apparatus and is a cross section taken along line 3—3 of FIG. 1. A handle 38 extends outwardly in a direction generally transverse to the side surface 22. Handle 38 includes a trigger 40 attached to a bar 42 which includes the knife blade 20. Bar 42 includes slots 44 and 46 so that as the trigger is moved toward handle 38, bar 42 moves to the right of FIG. 3 causing knife blade 20 to engage tape 14 to thereby sever it. Screws 48 pass through slots 44 and 46 to secure bar 42 to body 2.

Preferably knife blade 20 includes a sharpened edge which is not parallel to the axis of rotation of roller 12. This causes the blade 20 to encounter tape 14 at one edge first as it is pulled toward roller 12. As the roller deforms slightly, the blade edge can engage the entire width of the tape. This arrangement allows one to easily cut tape 14.

A preferred method of attaching rollers 8 and 12 to body 2 is shown in FIG. 3, and it will be appreciated that other techniques may also be used. A screw 50 secures an axle 52 to the body 2. A screw 54 engages a hole in axle 52 and urges a washer 56 against one of the rollers 8, 12 to secure the roller to body 2.

FIG. 3 illustrates the preferred arrangement wherein side surface 58 of roller 12 is coplanar with surface 22 of body 2. Side surface 60 of roller 8 is also preferably coplanar with surface 22 to permit easy alignment of the tape 14 with roller 12.

Figure 4:
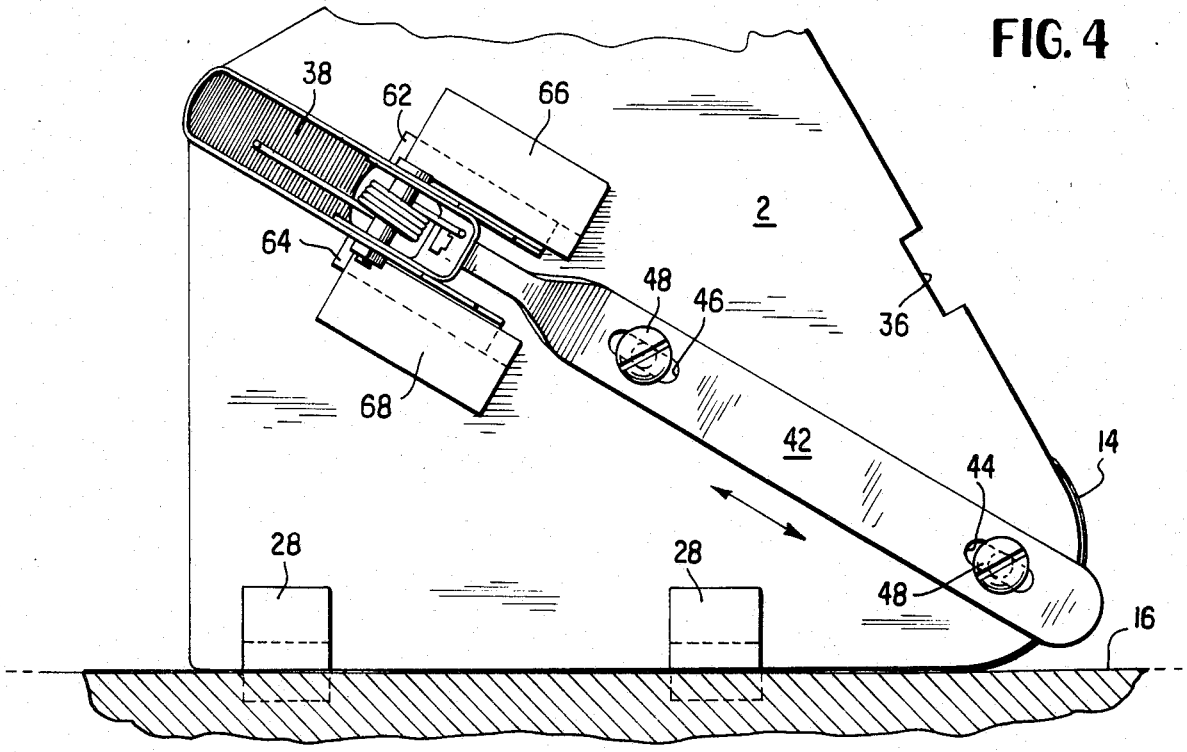
FIG. 4 is a side view from a direction opposite that shown in FIG. 1.

FIG. 4 shows how the handle 38 is preferably mounted to the body 2. Handle 38 has outwardly extending tabs 62, 64 which are engaged in a slot formed by elements 66 and 68, respectively.

It will be appreciated that an easily constructed and highly useful device has been described wherein tape may be applied to a surface and accurately aligned with a desired direction. Modifications within the scope of the appended claims will be apparent to those of skill in the art.

What is claimed is:

1. Apparatus for applying tape to an object comprising body means, spindle means mounted on said body means for receiving a roll of tape and allowing said roll of tape to rotate about a first axis, pressure roller means mounted on said body for receiving tape from said roll of tape on an outer surface thereof and pressing said tape onto said object, said pressure roller means being mounted for rotation about a second axis parallel to said first axis and having a side perpendicular to said second axis and wherein said body means comprises a first guide means having a substantially flat elongate surface which lies in a plane tangent to said outer surface of said pressure roller and has a first side portion coplanar with said side of said pressure roller whereby alignment of said first guide means will also align said pressure roller, said body means further comprising a second guide means having a second substantially flat elongate surface which lies in a second plane tangent to said outer surface of said pressure roller and including a second side portion coplanar with said side of said pressure roller.

2. Apparatus according to claim 1 further comprising alignment means attached to one of said guide means and extending outwardly from one of said side portions.

3. Apparatus according to claim 1 wherein each of said first guide means and said second guide means comprises mens for receiving alignment means.

4. Apparatus according to claim 3 wherein said means for receiving alignment means comprises at least one notch in each of said first guide means and said second guide means.

5. Apparatus according to claim 4 further comprising said alignment means, said alignment means comprising a first U-shaped portion for engaging either said first guide means or said second guide means and a second portion extending from said first U-shaped portion.

6. Apparatus according to claim 1 further comprising handle means extending outwardly from said body in a direction transverse to said side portion.

7. Apparatus according to claim 6 further comprising tape cutting means, said tape cutting means including a bar means and blade means, said bar means connecting said handle means to said blade means wherein movement of said bar means causes said blade means to engage said outer surface of said pressure roller to sever said tape.

8. Apparatus according to claim 7 wherein said blade means is elongate and has a sharpened edge, and where said sharpened edge extends at a non-zero angle to said second axis.

* * * * *